US008534204B2

(12) United States Patent
Blankenship

(10) Patent No.: US 8,534,204 B2
(45) Date of Patent: Sep. 17, 2013

(54) HATCH ASSEMBLY FOR A RAILCAR AND METHOD FOR ASSEMBLING THE SAME

(75) Inventor: Brian Wayne Blankenship, Jackson, MO (US)

(73) Assignee: American Railcar Industries, Inc., St. Charles, MO (US)

( * ) Notice: Subject to any disclaimer, the term of this patent is extended or adjusted under 35 U.S.C. 154(b) by 218 days.

(21) Appl. No.: 12/970,709

(22) Filed: Dec. 16, 2010

(65) Prior Publication Data

US 2012/0152146 A1 Jun. 21, 2012

(51) Int. Cl.
*B61D 3/00* (2006.01)
*B61D 9/00* (2006.01)

(52) U.S. Cl.
USPC ..... 105/308.1; 105/247; 105/280

(58) Field of Classification Search
USPC 105/238.1, 239, 247, 248, 280, 282.1–282.3, 105/308.1, 309, 310, 310.2
See application file for complete search history.

(56) References Cited

U.S. PATENT DOCUMENTS

| | | | | |
|---|---|---|---|---|
| 4,889,056 | A | 12/1989 | Stewart | |
| 5,311,824 | A | 5/1994 | Sauer et al. | |
| 5,314,218 | A | 5/1994 | Nadherny | |
| 5,697,121 | A | 12/1997 | Early | |
| 5,785,362 | A | 7/1998 | Nadherny | |
| RE35,925 | E | 10/1998 | Dohr et al. | |
| 5,829,359 | A * | 11/1998 | Dohr et al. | 105/310 |
| 6,039,362 | A | 3/2000 | Nadherny | |
| 7,427,089 | B2 | 9/2008 | Silverio et al. | |

* cited by examiner

*Primary Examiner* — R. J. McCarry, Jr.
(74) *Attorney, Agent, or Firm* — Armstrong Teasdale LLP

(57) ABSTRACT

A hatch assembly for use with a railway hopper car. The railway hopper car includes sidewalls, end walls, and bottom walls for defining an interior volume. The bottom walls define a cargo well that has an opening for discharging materials transported by the hopper car. The hatch assembly includes a support frame that is coupled proximate to a bottom of the cargo well. A hatch is slideably coupled to the support frame. The hatch is moveable between a closed position and an open position for selectively covering the cargo well opening. A hatch positioning system including a drive shaft that is coupled to the support frame, a locking assembly that is coupled to the drive shaft and is configured to selectively engage a locking bar, a positioning assembly that is coupled to the drive shaft, and a drive assembly that is coupled to the drive shaft.

25 Claims, 11 Drawing Sheets

HATCH ASSEMBLY FOR A RAILCAR AND METHOD FOR ASSEMBLING THE SAME

BACKGROUND OF THE INVENTION

The embodiments described herein relate generally to a hatch assembly for railcars and, more particularly, to a hatch assembly for a railway hopper car that includes a mechanical timing device that is configured to unlock a hatch just prior to moving the hatch from a closed position to an open position.

Railroad cars generally have one or more compartments for storing and transporting materials. Each compartment includes a floor that defines an opening that facilitates removing materials from the compartments through the floor. At least some known railroad cars include a hatch assembly that selectively provides access to the materials through the opening in the floor. Known hatch assemblies include a frame that is coupled to the floor and a hatch that is coupled to the frame to selectively cover the opening. At least some known hatch assemblies include a rack and pinion assembly that is coupled to the hatch to selectively position the hatch between an open and closed position. During operation of known railway cars, the hatch assembly may be subjected to various forces and moments that impart vibrations to the hatch and to the rack and pinion assembly that may cause the hatch to shift position and open when the railroad car is traveling. These unexpected shifts in position may cause the hatch to open and allow the material in the railcar to undesirably spill through opening.

At least some, known hatch assemblies include a locking assembly for locking the hatch in a closed position, and a separate positioning system for moving the hatch between the open and closed positions. At least some known positioning systems are actuated with large torque actuators that impart a large force to the positioning system to open the hatch. These known positioning systems can be damaged when the positioning system is actuated with the locking assembly engaged in the locked position. Moreover, at least some known locking assemblies are manually locked and unlocked prior to moving the hatch between the open and closed position. These known locking assemblies are oftentimes damaged when an operator actuates the positioning system to open the hatch before moving the locking assembly to an unlocked position. A hatch system is needed that facilitates unlocking the hatch before moving the hatch to an open position. Specifically, a hatch assembly is needed with a mechanical timing device that is configured to automatically unlock the hatch just prior to moving the hatch from the closed position to the open position.

BRIEF DESCRIPTION OF THE INVENTION

In one aspect, a hatch assembly for use with a railway hopper car is provided. The railway hopper car includes sidewalls, end walls, and bottom walls for defining an interior volume. The bottom walls define a cargo well that has an opening for discharging materials transported by the hopper car. The hatch assembly includes a support frame that is coupled proximate to a bottom of the cargo well. A hatch is slideably coupled to the support frame. The hatch is moveable between a closed position and an open position for selectively covering the cargo well opening. A locking bar is coupled to the support frame for locking the hatch in the closed position. A hatch positioning system including a drive shaft that is coupled to the support frame, a locking assembly that is coupled to the drive shaft and is configured to selectively engage the locking bar, a positioning assembly that is coupled to the drive shaft, and a drive assembly that is coupled to the drive shaft. The hatch positioning system is configured to unlock the hatch when the drive shaft is rotated through a first angle of rotation to cause the locking assembly to disengage the locking bar, and to move the hatch to the open position when the drive shaft is further rotated after the first angle of rotation.

In another aspect, a hatch control apparatus for controlling an operation of a discharge hatch assembly that is coupled to a railway hopper car is provided. The hatch assembly includes a support frame that is coupled to a cargo well that defines an opening on the railway hopper car. A hatch is slideably coupled to the support frame and is moveable between a closed position and an open position for selectively covering the cargo well opening. A locking bar is coupled to the support frame for locking the hatch in the closed position. The hatch control apparatus includes a locking assembly that includes a locking member that is pivotably coupled to the hatch. The locking assembly is configured to unlock the hatch by selectively displacing the locking member from engagement with the locking bar. A positioning assembly is coupled to the hatch. The positioning assembly is configured to move the hatch between the closed position and an intermediate position that is between the open position and the closed position. A drive assembly is coupled to the hatch. The drive assembly is configured to selectively move the hatch between the intermediate position and the open position. A drive shaft is operatively coupled to the locking assembly, to the positioning assembly, and to the drive assembly. The hatch control apparatus is configured to unlock the hatch when the drive shaft is rotated through a first angle of rotation causing the locking assembly to disengage the locking bar, and to move the hatch from the closed position to the open position when the drive shaft is further rotated after the first angle of rotation.

In yet another aspect, a method of assembling a railway hopper car is provided. The method includes coupling first and second opposing sidewalls extending along a longitudinal axis to first and second opposing end walls extending substantially perpendicularly to the longitudinal axis to form an upper portion of the hopper car. A plurality of well panels are coupled to the upper portion of the hopper car for forming a lower portion of the hopper car. The lower portion includes one or more cargo wells. Each of the well panels slopes inwardly from the upper portion to an opening. A support frame is coupled to the cargo well. A hatch is coupled to the support frame. The hatch is moveable between a closed position and an open position along the longitudinal axis to selectively cover the cargo well opening. A locking assembly is coupled to the hatch to selectively lock the hatch in the closed position. A positioning assembly is coupled to the hatch for moving the hatch between the open position and an intermediate position that is between the open position and closed position. A drive assembly is coupled to the hatch for moving the hatch between the intermediate position and the open position.

In a further another aspect, a railway hopper car is provided. The railway hopper car includes an upper portion that includes a first sidewall, an opposing second sidewall, a first end wall, and an opposing second end wall. A lower portion is coupled to the upper portion to define an interior volume of the hopper car. The lower portion includes one or more cargo wells. Each cargo well includes a plurality of inwardly sloping well panels that extend between an inner edge an outer edge. The outer edge defines an opening that provides access to the interior volume. A support frame is coupled proximate to a bottom of the cargo well. A hatch is slideably coupled to the support frame. The hatch includes a leading edge and a trailing edge. The hatch is moveable between a closed position and an open position for selectively covering the cargo well opening. A locking bar is coupled to the support frame for locking the hatch in the closed position. A drive shaft is coupled to the support frame. A locking assembly is coupled to the drive shaft. The locking assembly includes a locking member that is pivotably coupled to the hatch to selectively engage the locking bar to lock the hatch, and a cam that is coupled to the drive shaft and is configured to contact the locking member during rotation of the drive shaft to unlock the hatch. A positioning assembly is coupled to the drive shaft to move the hatch from the closed position to an intermediate position that is between the closed position and the open position. The positioning assembly includes a positioning rack that is coupled to the hatch and a positioning pinion that is coupled to the drive shaft. The positioning pinion includes at least one tooth that extends outwardly from an outer surface of the positioning pinion. The at least one tooth is positioned on the drive shaft relative to the cam such that the cam unlocks the hatch before the tooth contacts the positioning rack. A drive assembly is coupled to the drive shaft for moving the hatch between the intermediate position and the open positioned. The drive shaft is rotated through a first angle of rotation to cause the locking assembly to disengage the locking bar. The drive shaft is rotated through a second angle of rotation after the first angle of rotation to cause the positioning assembly to move the hatch from the closed position to the open position, and is rotated through a third angle of rotation after the second angle of rotation to cause the drive assembly to move the hatch from the intermediate position to the open position.

BRIEF DESCRIPTION OF THE DRAWINGS

FIG. 1 is a side view of an exemplary railway hopper car having a cargo well assembly in accordance with the present invention.

FIG. 2 is a partial cross-sectional view of the railway hopper car shown in FIG. 1 and taken along line 2-2, with an exemplary embodiment of the cargo well assembly.

FIG. 3 is an enlarged front-side view of the cargo well assembly shown in FIG. 1 and taken along area 3, with an exemplary hatch assembly.

FIG. 4 is a cross-sectional view of the hatch assembly shown in FIG. 3 and taken along line 4-4, with hatch assembly shown in a closed position.

FIG. 5 is a cross-sectional view of the hatch assembly shown in FIG. 3 and taken along line 5-5, with hatch assembly shown in an open position.

FIG. 6 is partial bottom sectional view of the hatch assembly shown in FIG. 3 and taken along line 6-6.

FIG. 7 is a partial perspective view of the hatch assembly shown in FIG. 3, with hatch assembly shown in an intermediate position.

FIG. 8 is an enlarged side view of the hatch assembly shown in FIG. 3 and taken along area 8.

FIG. 9 is a partial cross-sectional view of the hatch assembly shown in FIG. 8 and taken along line 9-9, showing an exemplary positioning assembly of the exemplary hatch assembly.

FIG. 10 is a partial cross-sectional view of the hatch assembly shown in FIG. 8 and taken along line 10-10, showing an exemplary drive assembly of the exemplary hatch assembly.

FIG. 11 is a partial cross-sectional view of the hatch assembly shown in FIG. 8 and taken along line 11-11, showing an exemplary locking assembly of the exemplary hatch assembly.

DETAILED DESCRIPTION OF THE INVENTION

The embodiments of a hatch assembly for use with a railway hopper car are described herein. The hatch assembly includes a mechanical timing device that enables an operator to rotate a shaft for unlocking a hatch just before moving the hatch from a closed position to an open position. More specifically, the hatch assembly includes a single drive shaft that is coupled to each of a locking assembly, a positioning assembly, and a driving assembly. The hatch assembly described herein includes a drive shaft that unlocks the hatch through a first rotation of the shaft, and opens the hatch through a second rotation of the shaft. This hatch assembly allows the operator to automatically unlock the hatch and move the hatch to the open position by manipulating a single drive shaft though a predefined angle of rotation, reducing time and cost associated with unloading material and reducing damage to the railcar.

Figure 1:
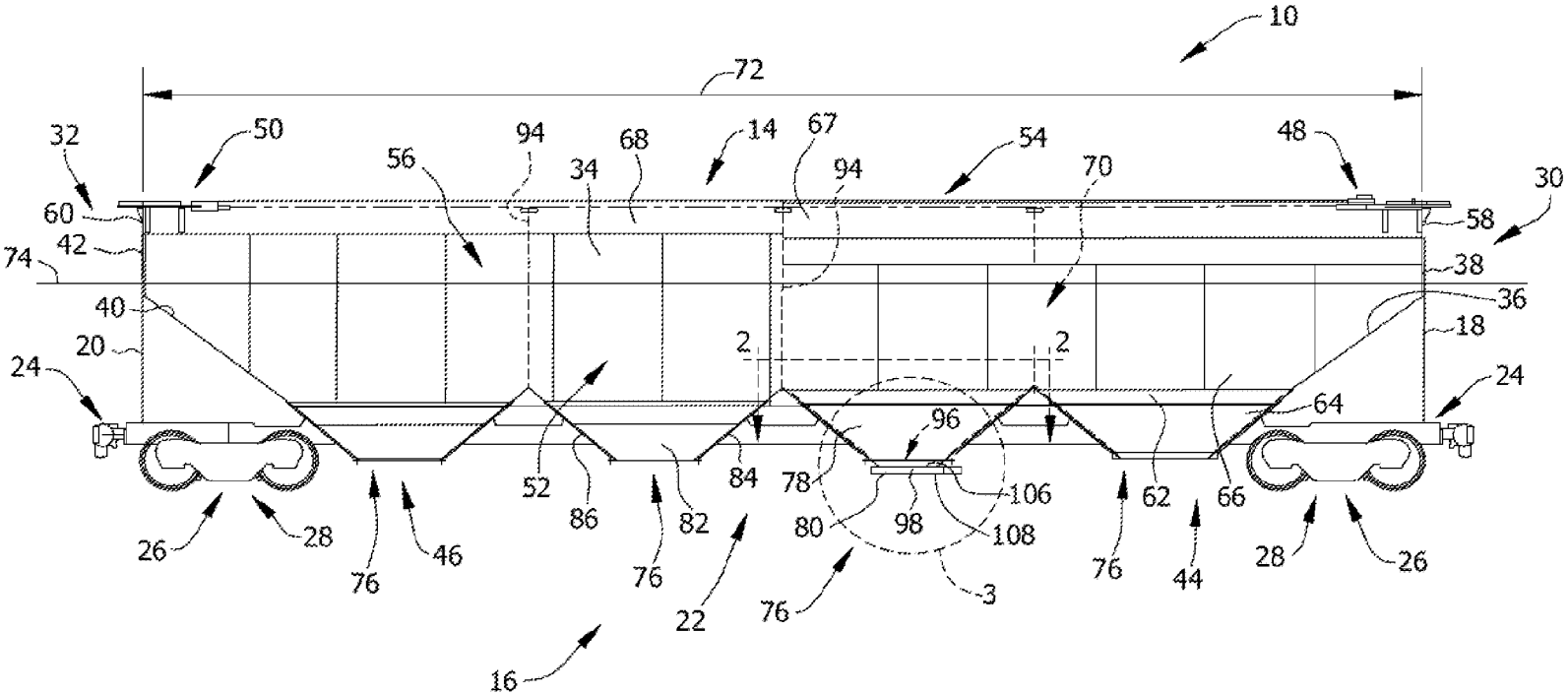
FIG. 1-11 show exemplary embodiments of the apparatus described herein.
Figure 2:
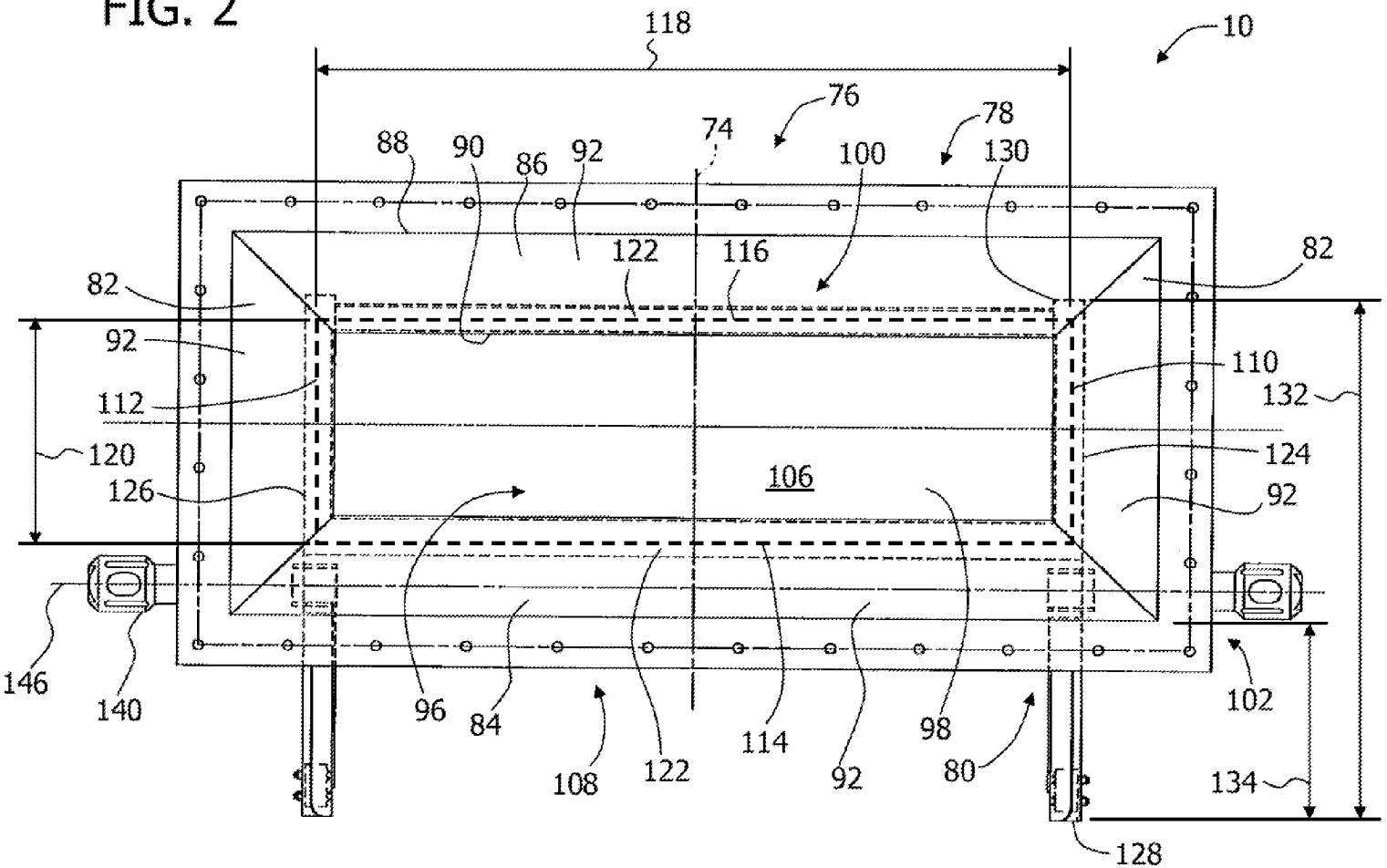

FIG. 1 is a side view of an exemplary railway hopper car 10. FIG. 2 is a partial cross-sectional view of railway hopper car 10 taken along line 2-2 shown in FIG. 1. Identical components shown in FIG. 2 are labeled with the same reference numbers used in FIG. 1. Railway hopper car 10 can be used to store and/or transport materials, such as dried distillers grains, dried distillers grains with solubles, and/or any other granular, semi-granular, or other flowable material.

In the exemplary embodiment, railway hopper car 10 includes an upper portion 14 that is coupled to a lower portion 16. Lower portion 16 includes a front sill assembly 18, a rear sill assembly 20, and a cargo assembly 22 that extends between front sill assembly 18 and rear sill assembly 20. Each sill assembly 18 and 20 includes a truck 24 that has a pair of axles 26 that are coupled to a pair of wheels 28. Upper portion 14 includes a front end structure 30, a rear end structure 32, and two opposing sidewalls 34 extending therebetween. Front end structure 30 includes a front sloped sheet 36 that is coupled to a first end wall, i.e. a front end wall 38. Front sloped sheet 36 extends obliquely inwardly from front end wall 38 towards rear end structure 32. Rear end structure 32 includes a rear sloped sheet 40 that is coupled to a second end wall, i.e. a rear end wall 42. Rear sloped sheet 40 extends obliquely inwardly from rear end wall 42 towards front end structure 30. Front end structure 30 is coupled to front sill assembly 18 and to a forward portion 44 of cargo assembly 22. Rear end structure 32 is coupled to rear sill assembly 20 and to a rear portion 46 of cargo assembly 22. Sidewalls 34 are coupled between front end wall 38 and rear end wall 42. A forward section 48 of sidewalls 34 is coupled to front end wall 38 and to front sloped sheet 36. A rearward section 50 of sidewalls 34 is coupled to rear end wall 42 and to rear sloped sheet 40. A bottom section 52 of sidewalls 34 is coupled to cargo assembly 22.

A roof assembly 54 is coupled to a top section 56 of sidewalls 34 such that sidewalls 34 extend between roof assembly 54 and cargo assembly 22. Roof assembly 54 is further coupled to a top 58 of front end wall 38 and a top 60 of rear end wall 42. In an alternative embodiment, roof assembly 54, sidewalls 34, front end wall 38 and rear end wall 42 are formed integrally to form upper portion 14. In the exemplary embodiment, at least one sill 62 is coupled to an outer surface 64 of cargo assembly 22 and an outer surface 66 of sidewalls 34. Sill 62 extends between front end structure 30 and rear end structure 32. At least one chord beam 67 extends between front end wall 38 and rear end wall 42 and is coupled to an outer surface 68 of roof assembly 54 and to sidewall outer surface 66. Sidewalls 34, roof assembly 54, and cargo assembly 22 together define an interior volume 70 extending between front end wall 38 and rear end wall 42. Interior volume 70 includes a length 72 extending along a longitudinal axis 74 defined between front end wall 38 and rear end wall 42.

In the exemplary embodiment, cargo assembly 22 includes a plurality of cargo well assemblies 76 that are each coupled to an adjacent cargo well assembly 76 such that cargo assembly 22 extends along longitudinal axis 74 between front end structure 30 and rear end structure 32. Each cargo well assembly 76 includes a cargo well 78 and a hatch assembly 80 that is coupled to cargo well 78. Cargo well 78 includes two opposing side well panels 82, a front well panel 84, and a rear well panel 86. Side well panels 82 are coupled between front well panel 84 and rear well panel 86 to form cargo well 78. In the exemplary embodiment, side well panels 82, front well panel 84, and rear well panel 86 each extend between an inner edge 88 and an outer edge 90 of cargo well 78. Side well panels 82, front well panel 84, and rear well panel 86 each include an inner surface 92 that extends downwardly and/or inwardly sloping from inner edge 88 to outer edge 90 to form cargo well 78 having a trapezoidal shape. In an alternative embodiment, cargo well 78 is formed having a conical shape. In the exemplary embodiment, front well panel 84 is coupled to an adjacent rear well panel 86 to form at least one longitudinal boundary 94 between adjacent cargo well assemblies 76 at the intersection of front well panel 84 and rear well panel 86. Outer edge 90 of cargo well 78 defines an opening 96 that is sized to provide access to interior volume 70 through opening 96. Hatch assembly 80 is slideably coupled to cargo well 78 and is sized to at least partially cover opening 96. Hatch assembly 80 is configured to move with respect to cargo well 78 to selectively provide access to interior volume 70 through opening 96.

In the exemplary embodiment, hatch assembly 80 includes a hatch 98, a support frame 100, and one or more hatch positioning systems 102. Hatch 98 is slideably coupled to support frame 100 and is positionable along longitudinal axis 74. Hatch 98 includes an inner surface 106 and an outer surface 108, and is substantially rectangular extending between a first side 110 and an opposite second side 112, and between a leading edge 114 and a trailing edge 116 along longitudinal axis 74. Hatch 98 has a length 118 that is defined between first side 110 and second side 112 substantially perpendicularly to longitudinal axis 74, and has a width 120 that is defined between leading edge 114 and trailing edge 116 along longitudinal axis 74.

In the exemplary embodiment, support frame 100 is coupled to outer edge 90 of cargo well 78 to at least partially define opening 96. Support frame 100 is configured to support hatch 98 from cargo well 78. Support frame 100 includes two opposing support beams 122, a first guiderail 124, and a second guiderail 126. Each support beam 122 is coupled to front well panel 84 and rear well panel 86, respectively, and is coupled between first guiderail 124 and second guiderail 126. First guiderail 124 is coupled to a side well panel 82 and extends between support beams 122 along longitudinal axis 74. Second guiderail 126 is coupled to an opposite side well panel 82 and extends between support beams 122 along longitudinal axis 74. First guiderail 124 and second guiderail 126 each extend between a first end 128 and a second end 130 and include a length 132 defined between first end 128 and second end 130 along longitudinal axis 74. In the exemplary embodiment, length 132 is approximately equal to two times width 120 of hatch 98. Alternatively, length 132 may be shorter than, or longer than, two times width 120. In the exemplary embodiment, first guiderail 124 and second guiderail 126 extend outwardly from cargo well assembly 76 a distance 134 defined between front well panel 84 and first end 128. Hatch 98 is slideably supported by first guiderail 124 and second guiderail 126 and is configured to move along length 132 to selectively provide access to interior volume 70 through opening 96.

Figure 3:
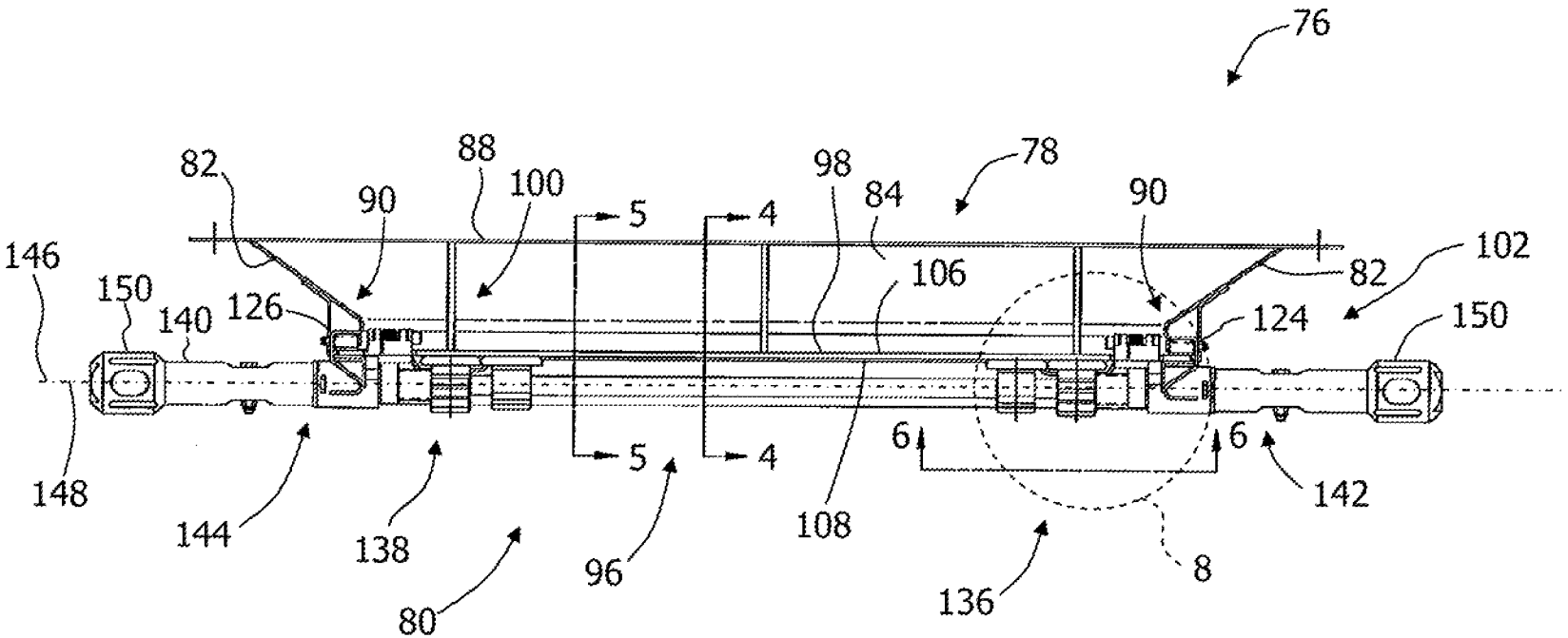
Figure 4:
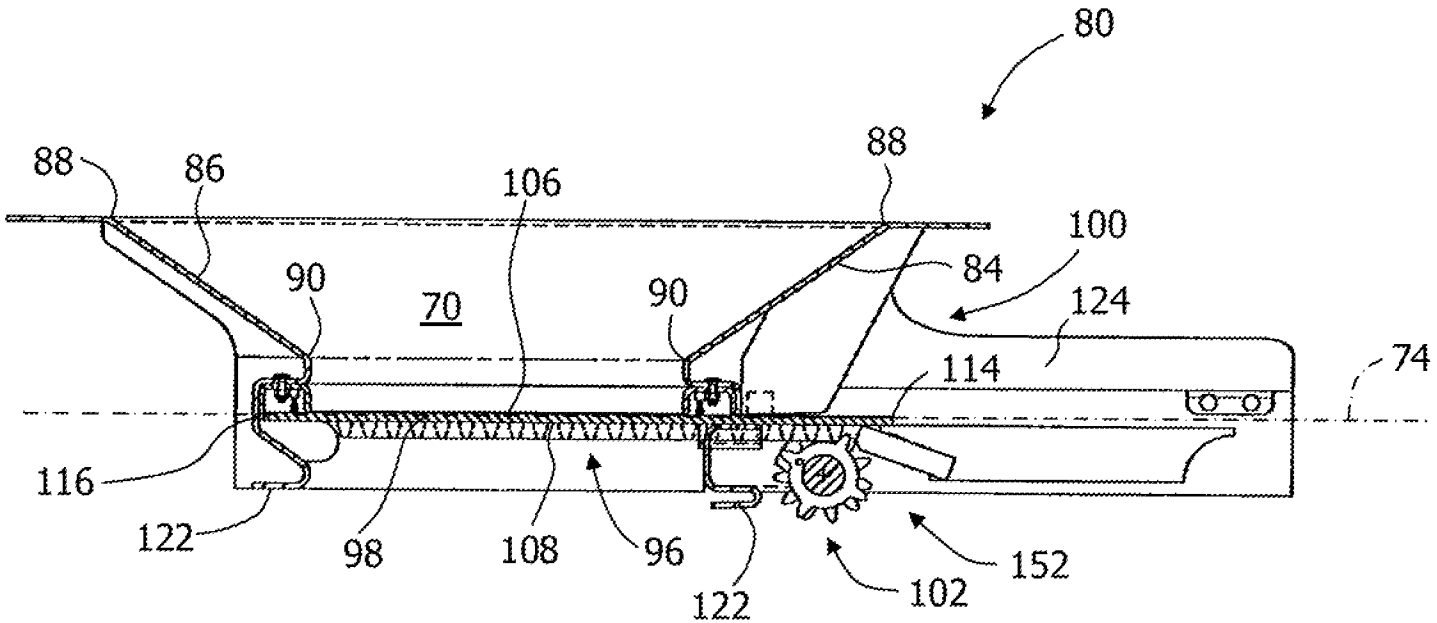
Figure 5:
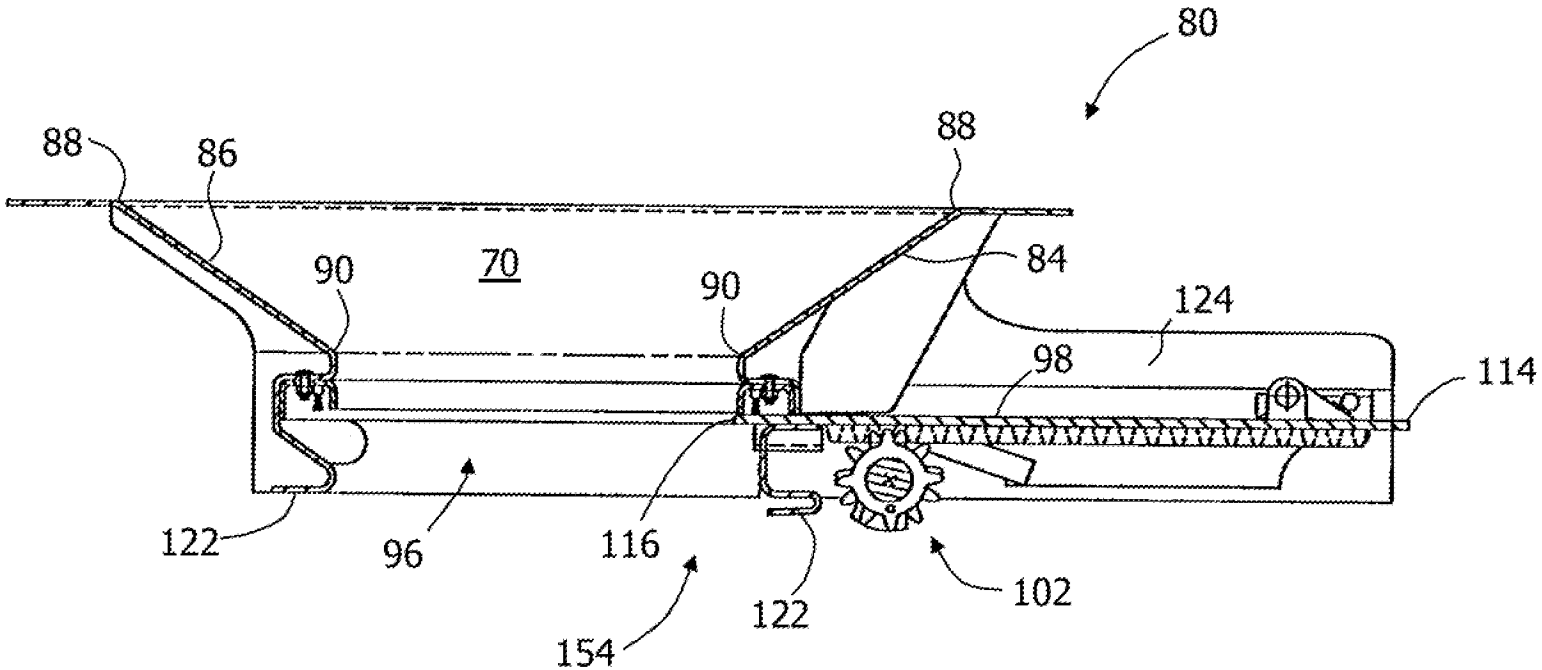

FIG. 3 is an enlarged front-side view of cargo well assembly 76 taken along area 3 shown in FIG. 1. FIG. 4 is a cross-sectional view of hatch assembly 80 taken along line 4-4 shown in FIG. 3. FIG. 5 is another cross-sectional view of hatch assembly 80 taken along line 5-5 shown in FIG. 3. Identical components shown in FIG. 3 are labeled with the same reference numbers used in FIG. 2. Identical components shown in FIG. 4 and FIG. 5 are labeled with the same reference numbers used in FIG. 3. Referring to FIG. 2 and FIG. 3, in the exemplary embodiment, hatch assembly 80 includes a first hatch positioning system 136, a second hatch positioning system 138, and a drive shaft 140 that is coupled between first hatch positioning system 136 and second hatch positioning system 138. Each hatch positioning system 102 is substantially similar and is positioned adjacent outer edge 90 of cargo well 78. Drive shaft 140 is rotatably coupled to support frame 100 and extends between a first end 142 and a second end 144 and defines a centerline axis 146 that extends between first end 142 and second end 144. In the exemplary embodiment, first end 142 is coupled to first guiderail 124 and second end 144 is coupled to second guiderail 126 such that drive shaft 140 is oriented substantially perpendicular to longitudinal axis 74. Drive shaft 140 is configured to rotate about an axis of rotation 148 that is coaxial with centerline axis 146. Hatch positioning system 102 is coupled between hatch 98 and drive shaft 140 and is configured to move hatch 98 along longitudinal axis 74 upon a rotation of drive shaft 140. First end 142 and second end 144 each include a capstan 150 that is configured to receive an actuator (not shown). First hatch positioning system 136 is positioned adjacent first end 142 of drive shaft 140 and side well panel 82. Second hatch positioning system 138 is positioned adjacent second end 144 of drive shaft 140 and an opposite side well panel 82.

Referring to FIG. 4 and FIG. 5, in the exemplary embodiment, hatch 98 is slideably coupled to support frame 100 and is configured to selectively cover opening 96, as desired. Hatch 98 is movable along longitudinal axis 74 between a first position (shown in FIG. 4), i.e., a closed position 152 and a second position (shown in FIG. 5), i.e., an open position 154. In closed position 152, hatch 98 covers opening 96 to prevent material contained in interior volume 70 of cargo well 78 from being channeled though opening 96. In open position 154, hatch 98 does not completely cover opening 96 such that material is channeled from interior volume 70 through opening 96. Hatch positioning system 102 is configured to selectively move hatch 98 between closed position 152 and open position 154.

Figure 6:
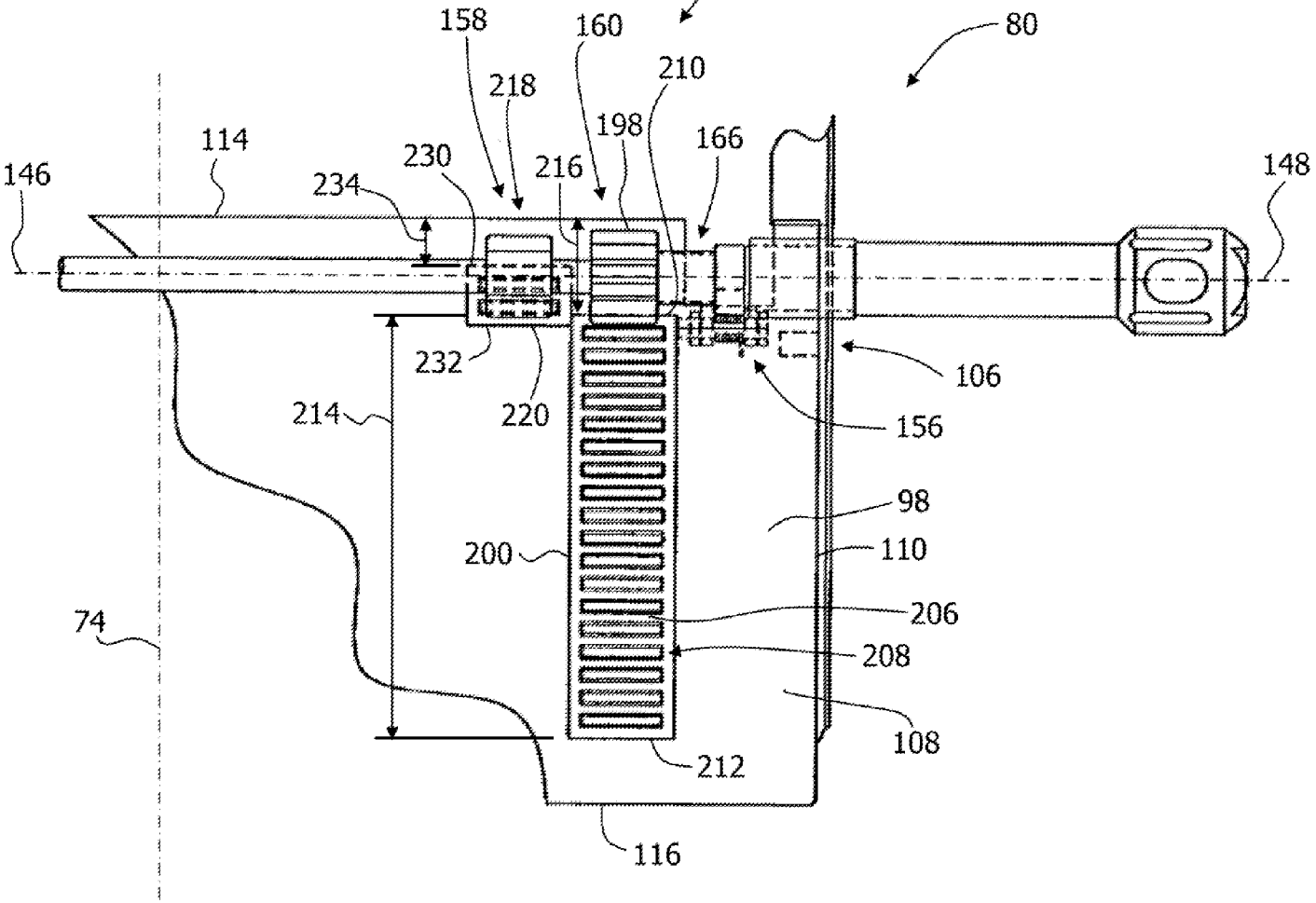
Figure 7:
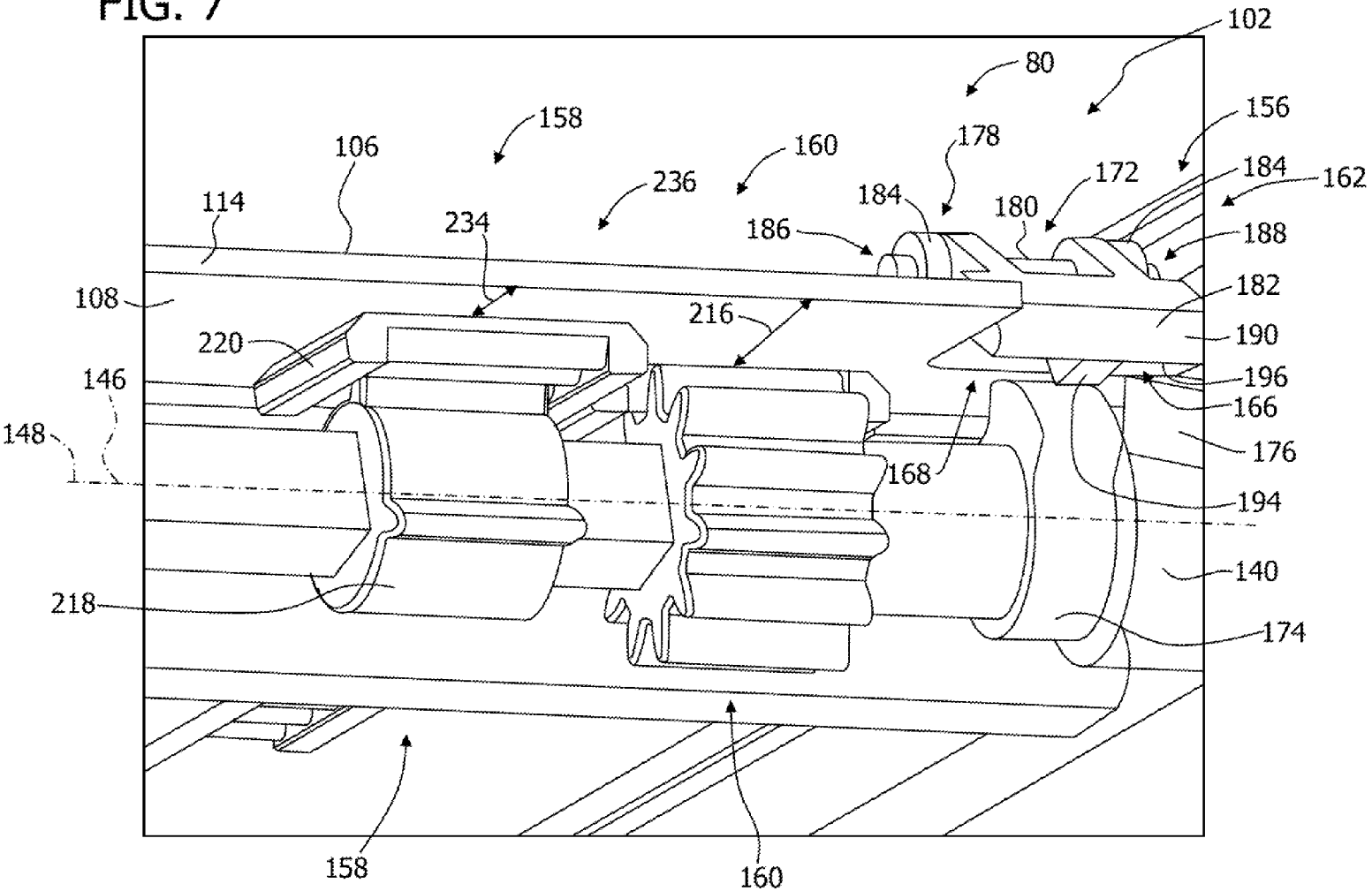
Figure 8:
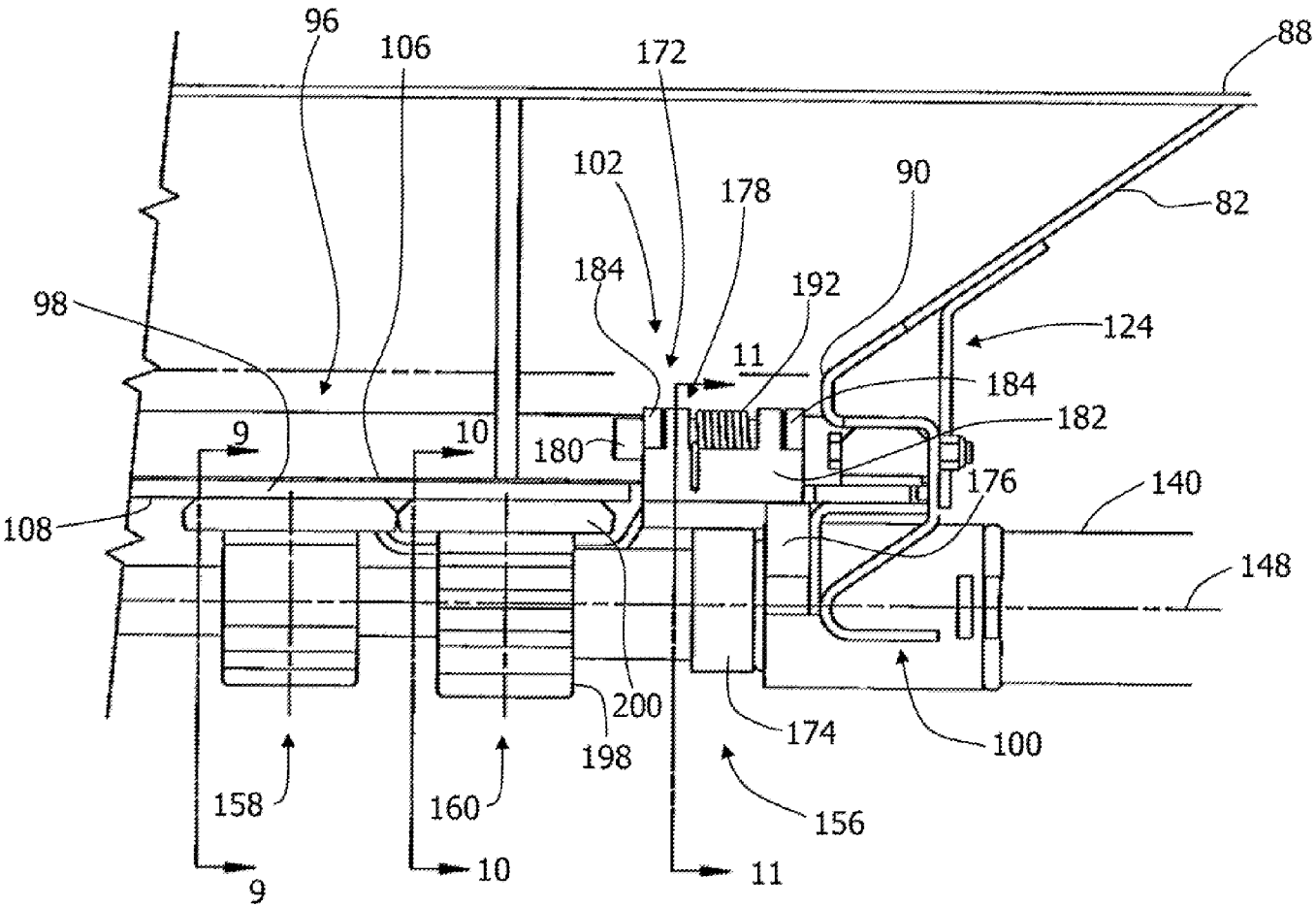
Figure 9:
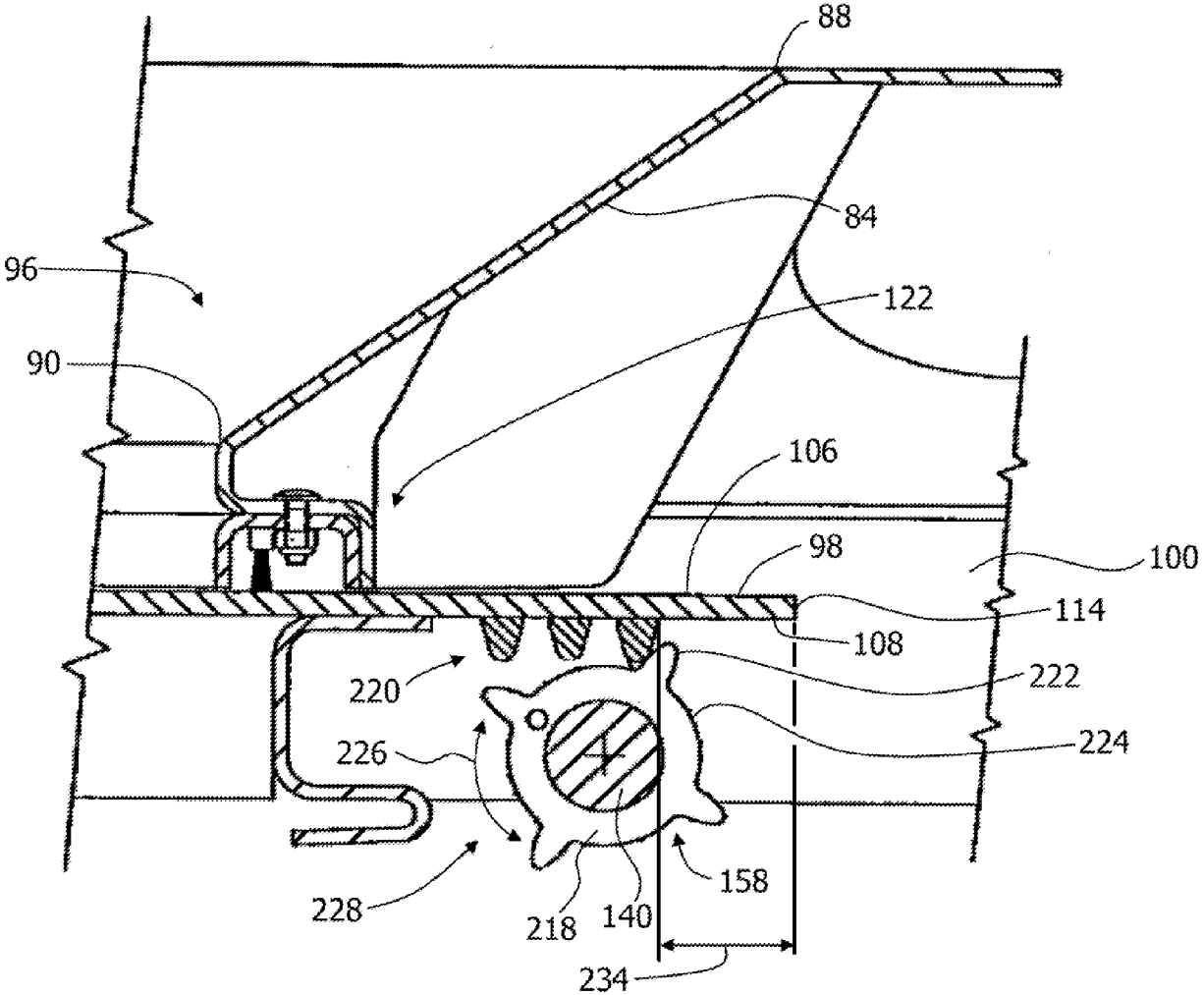
Figure 10:
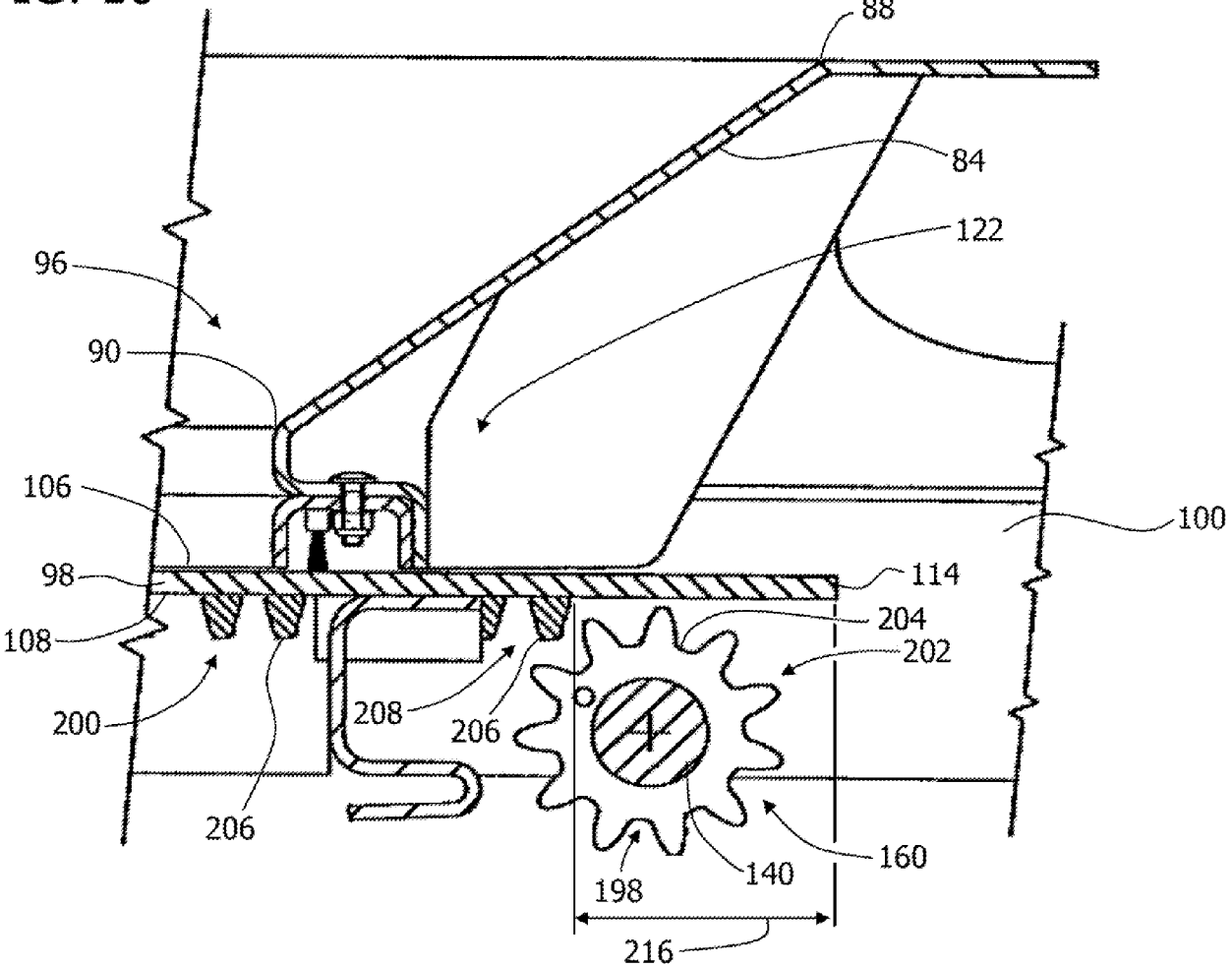
Figure 11:
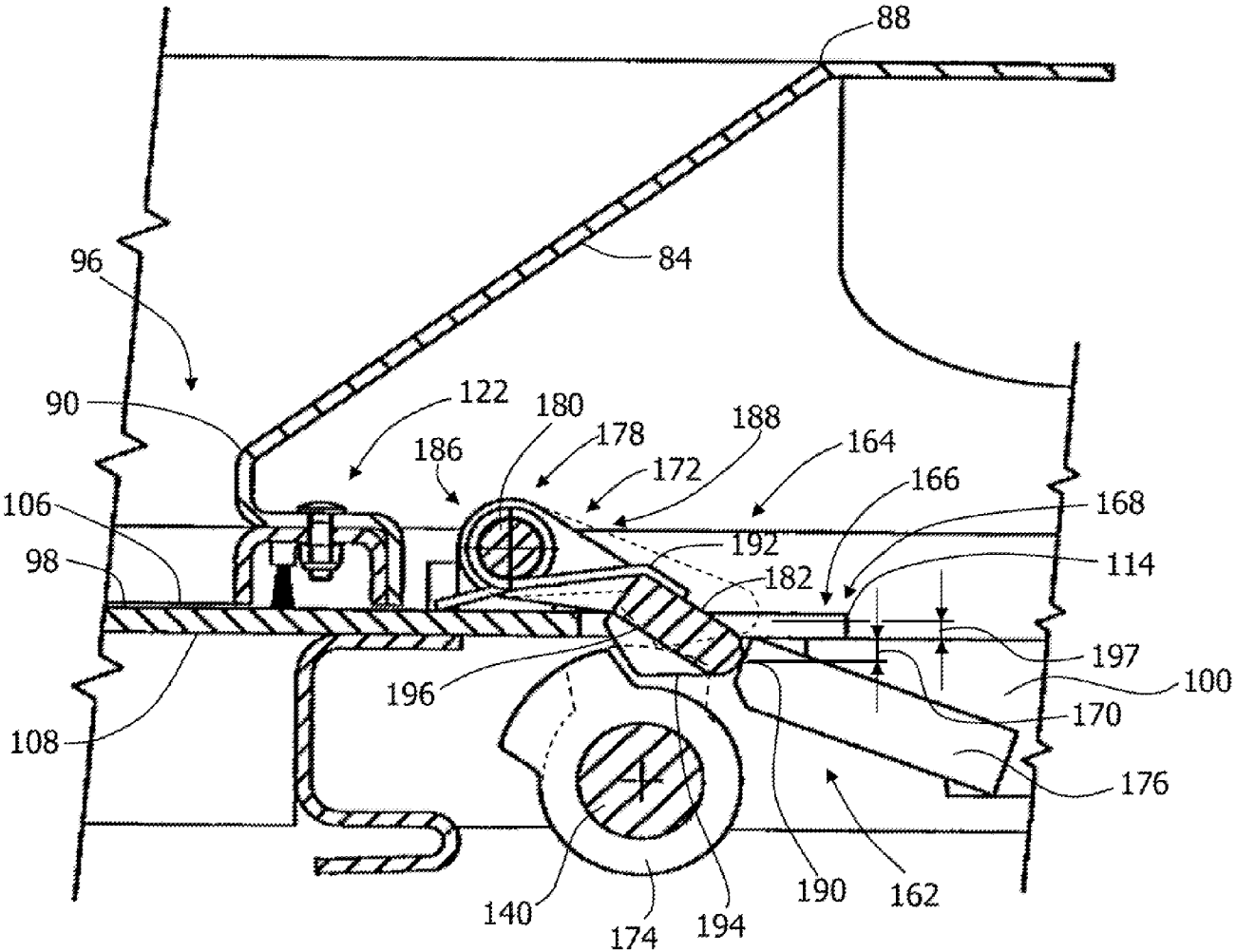

FIG. 6 is partial bottom sectional view of hatch assembly 80 taken along line 6-6 shown in FIG. 3. FIG. 7 is a partial perspective view of hatch assembly 80. FIG. 8 is an enlarged side view of hatch assembly 80 taken along area 8 shown in FIG. 3. FIG. 9 is a partial cross-sectional view of hatch positioning system 102 taken along line 9-9 shown in FIG. 8. FIG. 10 is a partial cross-sectional view of hatch positioning system 102 taken along line 10-10 shown in FIG. 8. FIG. 11 is a partial cross-sectional view of hatch positioning system 102 taken along line 11-11 shown in FIG. 8. Identical components shown in FIGS. 6-11 are labeled with the same reference numbers used in FIG. 3. In the exemplary embodiment, hatch positioning system 102 includes a locking assembly 156, a positioning assembly 158, and a drive assembly 160. Locking assembly 156 is coupled to inner surface 106 of hatch 98 and is positioned adjacent first side 110 of hatch 98. Locking assembly 156 is movable between a first position (shown in FIG. 11), i.e., a locked position 162 and a second position (shown in phantom lines is FIG. 11), i.e., an unlocked position 164. In locked position 162, locking assembly 156 locks hatch 98 and prevents hatch 98 from moving from closed position 152 to open position 154. In unlocked position 164, locking assembly 156 unlocks hatch 98 and enables hatch 98 to move between closed position 152 and open position 154. In the exemplary embodiment, leading edge 114 of hatch 98 defines a rectangular opening 166 that extends from leading edge 114 towards trailing edge 116. Opening 166 extends from inner surface 106 to outer surface 108 of hatch 98. Locking assembly 156 is positioned adjacent opening 166 and is oriented with respect to hatch 98 such that at least a portion of locking assembly 156 extends through opening 166 and extends a distance 170 from outer surface 108 of hatch 98.

Referring to FIG. 7, FIG. 8, and FIG. 11, in the exemplary embodiment, locking assembly 156 includes a locking member 172 that is coupled to inner surface 106 of hatch 98, a cam 174 that is coupled to drive shaft 140, and a locking bar 176 that is coupled to support frame 100. Locking member 172 includes a support assembly 178, a pin 180, and a locking arm 182. Support assembly 178 is coupled to inner surface 106 and includes opposing support arms 184 that each extend outwardly from inner surface 106. Support arms 184 define a cooperative opening 186 that extends through each support arm 184 and is oriented substantially parallel to centerline axis 146 of drive shaft 140. Locking arm 182 is positioned between support arms 184 and is pivotably coupled to support arms 184 with pin 180. Locking arm 182 extends between a root portion 188 and a tip portion 190. Root portion 188 at least partially defines cooperative opening 186 and is coupled to support assembly 178 with pin 180 inserted through cooperative opening 186 of support assembly 178 and root portion 188. Locking arm 182 extends obliquely from support assembly 178 and through hatch opening 166 such that tip portion 190 is positioned distance 170 from outer surface 108 of hatch 98. A spring 192 is coupled to support assembly 178 and to locking arm 182 to bias locking arm 182 towards hatch 98. Tip portion 190 includes a caming surface 194 that extends outwardly from an outer surface 196 of locking arm 182 towards drive shaft 140. Cam 174 is coupled to drive shaft 140 such that a rotation of drive shaft 140 rotates cam 174 about axis 148. Cam 174 extends outwardly from drive shaft 140 and is sized, shaped, and oriented to contact caming surface 194 during rotation of drive shaft 140.

In the exemplary embodiment, locking bar 176 is coupled to support frame 100 and extends obliquely from support frame 100 towards outer surface 108 of hatch 98. Locking bar 176 is positioned with respect to locking arm 182 such that locking bar 176 may contact locking arm 182. In locked position 162, locking arm 182 extends obliquely from support assembly 178 towards locking bar 176 and through opening 166. Moreover, in locked position 162, tip portion 190 is positioned with respect to locking bar 176 such that tip portion 190 may contact, or engage, locking bar 176 to lock hatch 98 and prevent hatch 98 from moving from closed position 152 to open position 154. In unlocked position 164, tip portion 190 is positioned a distance 197 from locking bar 176 such that tip portion 190 does not contact, or is disengaged from, locking bar 176 to unlock hatch 98 and enable hatch 98 to move from moving from closed position 152 to open position 154.

During rotation of drive shaft 140, cam 174 is rotated to contact caming surface 194 to pivot locking arm 182 about pin 180 and move tip portion 190 towards outer surface 108 of hatch 98. Cam 174 moves tip portion 190 towards hatch 98 such that tip portion 190 does not contact locking bar 176 to enable hatch 98 to be moved from closed position 152 to open position 154.

Referring to FIG. 6, FIG. 8, and FIG. 10, in the exemplary embodiment, drive assembly 160 is positioned between locking assembly 156 and positioning assembly 158. Drive assembly 160 includes a drive pinion 198 and a drive rack 200. Drive pinion 198 is coupled to drive shaft 140 such that a rotation of drive shaft 140 rotates drive pinion 198 about axis of rotation 148. Drive rack 200 is coupled to outer surface 108 of hatch 98 and is positioned with respect to drive pinion 198 such that drive pinion 198 engages drive rack 200 to move hatch 98 between closed position 152 and open position 154. In the exemplary embodiment, drive pinion 198 includes a plurality of circumferentially-spaced teeth 202 that extend radially outwardly from an outer surface 204 of drive pinion 198. Drive rack 200 includes a plurality of bars 206 that are axially-spaced along outer surface 108 to define a slot 208 between each bar 206 that is sized to receive teeth 202 therein. Drive rack 200 extends between a first end 210 and an opposite second end 212, and is oriented with respect to longitudinal axis 74 to facilitate moving hatch 98 along longitudinal axis 74. Drive rack 200 has a length 214 defined between first end 210 and second end 212 that enables drive assembly 160 to move hatch 98 between closed position 152 and open position 154. First end 210 of drive rack 200 is position a first distance 216 from leading edge 114 of hatch 98 along longitudinal axis 74 such that drive pinion 198 does not contact drive rack 200 when hatch 98 is in closed position 152.

Referring to FIG. 6, FIG. 7, and FIG. 9, in the exemplary embodiment, positioning assembly 158 includes a positioning pinion 218 and a positioning rack 220. Positioning pinion 218 is coupled to drive shaft 140 such that a rotation of drive shaft 140 rotates positioning pinion 218 about axis of rotation 148. Positioning pinion 218 includes at least one tooth 222 that extends radially outwardly from an outer surface 224 of positioning pinion 218. In the exemplary embodiment, tooth 222 is oriented on drive shaft 140 with respect to cam 174 such that cam 174 contacts caming surface 194 of locking arm 182 to unlock hatch 98 before tooth 222 engages positioning rack 220 as cam 174 and positioning pinion 218 are rotated by drive shaft 140. In one embodiment, adjacent teeth 222 are spaced a circumferential distance 226 to define a gap 228 between adjacent teeth 222. Gap 228 is sized to enable positioning pinion 218 to be rotated through a predefined angle of rotation without contacting positioning rack 220, and to enable cam 174 to unlock hatch 98 before positioning pinion 218 engages positioning rack 220 to move hatch 98.

In the exemplary embodiment, positioning rack 220 is coupled to outer surface 108 of hatch 98 and is positioned with respect to positioning pinion 218 such that positioning pinion 218 engages positioning rack 220 during a rotation of drive shaft 140. Positioning rack 220 is oriented with respect to longitudinal axis 74 to facilitate moving hatch 98 along longitudinal axis 74. Positioning rack 220 extends between a first end 230 and a second end 232 along longitudinal axis 74. First end 230 of positioning rack 220 is positioned a second distance 234 from leading edge 114 of hatch 98 that is less than first distance 216 of drive rack 200 such that first end 230 of positioning rack 220 is closer to leading edge 114 of hatch 98 than first end 210 of drive rack 200.

In the exemplary embodiment, positioning assembly 158 is configured to move hatch 98 from closed position 152 (shown in FIG. 4) to a third position (shown in FIG. 7), i.e. an intermediate position 236, that is between closed position 152 and open position 154 (shown in FIG. 5). In closed position 152, positioning rack 220 is positioned with respect to positioning pinion 218 such that positioning pinion 218 contacts positioning rack 220 when drive shaft 140 is rotated through a predefined angle of rotation to move hatch 98 from closed position 152 to intermediate position 236. In intermediate position 236, drive rack 200 is positioned in contact with drive pinion 198 to enable drive assembly 160 to move hatch 98 from intermediate position 236 to open position 154 during rotation of drive shaft 140.

In the exemplary embodiment, drive shaft 140 is configured to rotate positioning pinion 218, drive pinion 198, and cam 174 about axis 148 simultaneously. During operation of hatch positioning system 102, with hatch 98 in closed position 152, drive shaft 140 is rotated through a first angle of rotation to rotate cam 174 to contact locking arm 182 and move locking arm 182 from the locked position to the unlocked position. As drive shaft 140 rotates through the first angle of rotation, positioning pinion 218 is rotated to a position that is adjacent positioning rack 220. After cam 174 has moved locking arm 182 to the unlocked position, drive shaft 140 is rotated through a second angle of rotation to rotate positioning pinion 218 to engage positioning rack 220 and move hatch 98 from closed position 152 to intermediate position 236. As drive shaft 140 is rotated through the second angle of rotation, drive rack 200 is positioned adjacent drive pinion 198. After hatch 98 has been moved to intermediate position 236, drive shaft 140 is rotated through a third angle of rotation to rotate drive pinion 198 to engage drive rack 200 and to move hatch 98 from intermediate position 236 to open position 154.

The above-described embodiments facilitate assembling a railway hopper car having a hatch assembly that includes a mechanical timing mechanism that includes a drive shaft that facilitates unlocking a hatch before moving the hatch from a closed position to an open position. The above-described hatch assembly is a cost effective and efficient means to assemble a railway hopper car that facilitates unlocking the hatch and moving the hatch to the open position by rotating a drive shaft though a predefined angle of rotation. The hatch assembly includes a drive shaft that is coupled to each of a locking assembly, a positioning assembly, and a driving assembly. The hatch assembly automatically unlocks the hatch through a first rotation of the shaft and opens the hatch through a second rotation of the shaft, which occurs after the first rotation. As a result, the hatch assembly facilitates reducing time and cost associated with unloading material and reducing damage to the railcar.

Exemplary embodiments of a hatch assembly for a railcar and method of assembling the same are described above in detail. The hatch assembly and method are not limited to the specific embodiments described herein, but rather, components of apparatus and/or steps of the method may be utilized independently and separately from other components and/or steps described herein. For example, the hatch assembly may also be used in combination with other railway containers and methods, and are not limited to practice with only the railway hopper car and methods as described herein. Further, the exemplary embodiment can be implemented and utilized in connection with many other hatch assembly applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A hatch assembly for use with a railway hopper car, the railway hopper car including sidewalls, end walls, and bottom walls for defining an interior volume, the bottom walls defining a cargo well having an opening for discharging materials transported by the hopper car, said hatch assembly comprising:

a support frame coupled proximate to a bottom of the cargo well;

a hatch slideably coupled to said support frame, said hatch moveable between a closed position and an open position for selectively covering the cargo well opening;

a locking bar coupled to said support frame for locking said hatch in the closed position; and a hatch positioning system comprising a drive shaft coupled to said support frame, a locking assembly coupled to said drive shaft and configured to selectively engage said locking bar, a positioning assembly coupled to said drive shaft, and a drive assembly coupled to said drive shaft, wherein said hatch positioning system is configured to unlock said hatch when said drive shaft is rotated through a first angle of rotation causing said locking assembly to disengage said locking bar, and to move said hatch to the open position when said drive shaft is further rotated after the first angle of rotation.

2. A hatch assembly in accordance with claim 1, wherein said hatch positioning system is configured to move said hatch between the open position, the closed position, and an intermediate position that is between the open position and the closed position.

3. A hatch assembly in accordance with claim 2, wherein said positioning assembly is configured to move said hatch between the open position and the intermediate position, said drive assembly is configured to move said hatch between the intermediate position and the open position.

4. A hatch assembly in accordance with claim 2, wherein said positioning assembly is configured to move said hatch from the closed position to the intermediate position when said drive shaft rotates through a second angle of rotation after said locking assembly disengages said locking bar to unlock said hatch.

5. A hatch assembly in accordance with claim 4, wherein said drive assembly is configured to move said hatch from the intermediate position to the open position when said drive shaft rotates through a third angle of rotation after said positioning assembly has moved said hatch from the closed position to the intermediate position.

6. A hatch assembly in accordance with claim 1, wherein said locking assembly is movable between a first position and a second position, said locking assembly is in contact with said locking bar when in the first position to lock said hatch and is disengaged from said locking bar when in the second position to unlock said hatch.

7. A hatch assembly in accordance with claim 6, wherein said locking assembly is configured to move from the first position to the second position when said drive shaft rotates through the first angle of rotation with said hatch in the closed position.

8. A hatch assembly in accordance with claim 1, wherein said locking assembly comprises:

a support assembly coupled to said hatch; and a locking member pivotably coupled to said support assembly, said locking member movable from a position adjacent said locking bar for locking said hatch and a position a distance from said locking bar for unlocking said hatch.

9. A hatch assembly in accordance with claim 8, wherein said locking assembly further comprises a cam coupled to said drive shaft, said cam configured to contact said locking member during rotation of said drive shaft to unlock said hatch.

10. A hatch assembly in accordance with claim 9, wherein said positioning assembly comprises:

a positioning rack coupled to said hatch; and a positioning pinion coupled to said drive shaft, said positioning pinion comprising at least one tooth extending outwardly from an outer surface of said positioning pinion, said at least one tooth being positioned on said drive shaft relative to said cam such that said cam unlocks said hatch before said tooth contacts said positioning rack.

11. A hatch assembly in accordance with claim 10, wherein said drive assembly comprises:

a drive rack coupled to said hatch; and a drive pinion coupled to said drive shaft, said drive pinion configured to engage in meshing contact with said drive rack to move said hatch between the closed position and the open position.

12. A hatch assembly in accordance with claim 11, wherein said hatch includes a leading edge and a trailing edge, said positioning rack is positioned closer to said leading edge of said hatch than said driving rack such that said positioning assembly moves said hatch from the closed position towards the open position before said driving pinion contacts said driving rack.

13. A hatch control apparatus for controlling an operation of a discharge hatch assembly coupled to a railway hopper car, the hatch assembly including a support frame coupled to a cargo well that defines an opening on the railway hopper car, a hatch slideably coupled to the support frame and moveable between a closed position and an open position for selectively covering the cargo well opening, and a locking bar coupled to the support frame for locking the hatch in the closed position, said hatch control apparatus comprising:

a locking assembly comprising a locking member pivotably coupled to the hatch, said locking assembly configured to unlock the hatch by selectively displacing said locking member from engagement with the locking bar;

a positioning assembly coupled to the hatch, said positioning assembly configured to move the hatch between the closed position and an intermediate position that is between the open position and the closed position;

a drive assembly coupled to the hatch, said drive assembly configured to selectively move the hatch between the intermediate position and the open position; and a drive shaft operatively coupled to said locking assembly, said positioning assembly, and said drive assembly, wherein said hatch control apparatus is configured to unlock the hatch when said drive shaft is rotated through a first angle of rotation causing said locking assembly to disengage the locking bar, and to move the hatch from the closed position to the open position when said drive shaft is further rotated after the first angle of rotation.

14. A hatch control apparatus in accordance with claim 13, wherein said drive shaft rotates through a second angle of rotation to move the hatch from the closed position to the intermediate position, and rotates through a third angle of rotation to move the hatch from the intermediate position to the open position.

15. A hatch control apparatus in accordance with claim 13, wherein said locking assembly is movable between a first position and a second position, said locking assembly is in contact with the locking bar when in the first position to lock the hatch and is disengaged from the locking bar when in the second position to unlock the hatch.

16. A hatch control apparatus in accordance with claim 15, wherein said locking assembly is configured to move from the first position to the second position when said drive shaft rotates through the first angle of rotation with the hatch in the closed position.

17. A hatch control apparatus in accordance with claim 13, wherein said locking assembly further comprises a cam coupled to said drive shaft, said cam configured to contact said locking member during rotation of said drive shaft to unlock the hatch.

18. A hatch control apparatus in accordance with claim 17, wherein said positioning assembly comprises:

a positioning rack coupled to the hatch; and a positioning pinion coupled to said drive shaft, said positioning pinion comprising at least one tooth extending outwardly from an outer surface of said positioning pinion, said at least one tooth being positioned on said drive shaft relative to said cam such that said cam unlocks the hatch before said tooth contacts said positioning rack.

19. A hatch control apparatus in accordance with claim 18, wherein said drive assembly comprises:

a drive rack coupled to the hatch; and a drive pinion coupled to said drive shaft, said drive pinion configured to engage in meshing contact with said drive rack to move the hatch between the closed position and the open position.

20. A hatch control apparatus in accordance with claim 19, wherein the hatch includes a leading edge and a trailing edge, said positioning rack is positioned closer to the leading edge of the hatch than said driving rack such that said positioning assembly moves the hatch from the closed position towards the open position before said driving pinion contacts said driving rack.

21. A method of assembling a railway hopper car, said method comprising:

coupling first and second opposing sidewalls extending along a longitudinal axis to first and second opposing end walls extending substantially perpendicularly to the longitudinal axis to form an upper portion of the hopper car;

coupling a plurality of well panels to the upper portion of the hopper car for forming a lower portion of the hopper car, the lower portion including one or more cargo wells, each of the well panels sloping inwardly from the upper portion to an opening;

coupling a support frame to the cargo well;

coupling a hatch to the support frame, the hatch moveable between a closed position and an open position along the longitudinal axis to selectively cover the cargo well opening;

coupling a locking assembly to the hatch to selectively lock the hatch in the closed position;

coupling a positioning assembly to the hatch for moving the hatch between the open position and an intermediate position that is between the open position and closed position; and coupling a drive assembly to the hatch for moving the hatch between the intermediate position and the open position.

22. A method in accordance with claim 21, further comprising coupling a drive shaft to the locking assembly, the positioning assembly, and the driving assembly, the drive shaft configured to rotate through a first angle of rotation to unlock the hatch, to rotate through a second angle of rotation to move the hatch from the closed position to the intermediate position, and to rotate through a third angle of rotation to move the hatch from the intermediate position to the open position.

23. A method in accordance with claim 21, wherein said coupling a locking assembly to the hatch comprises:

coupling a locking bar to the support frame, the locking bar extending obliquely from the support frame towards the hatch;

coupling a support assembly to the hatch;

coupling a locking member to the support assembly, the locking member pivotable between a first position and a second position, the locking assembly is in contact with the locking bar when in the first position to lock the hatch and is disengaged from the locking bar when in the second position to unlock the hatch; and coupling a cam to the drive shaft, the cam configured to contact the locking member during rotation of the drive shaft to move the locking member from the first position to the second position.

24. A method in accordance with claim 23, wherein said coupling a positioning assembly to the hatch comprises:

coupling a positioning rack to the hatch; and coupling a positioning pinion to the drive shaft, the positioning pinion including at least one tooth extending outwardly from an outer surface of the positioning pinion, the at least one tooth being positioned on the drive shaft relative to the cam such that the cam unlocks the hatch before the tooth contacts the positioning rack.

25. A railway hopper car comprising:

an upper portion comprising a first sidewall, an opposing second sidewall, a first end wall, and an opposing second end wall;

a lower portion coupled to said upper portion to define an interior volume of said hopper car, said lower portion comprising one or more cargo wells, each cargo well including a plurality of inwardly sloping well panels that extend between an inner edge and an outer edge, said outer edge defining an opening providing access to the interior volume;

a support frame coupled proximate to a bottom of said cargo well;

a hatch slideably coupled to said support frame, said hatch comprising a leading edge and a trailing edge, said hatch moveable between a closed position and an open position for selectively covering said cargo well opening;

a locking bar coupled to said support frame for locking said hatch in the closed position;

a drive shaft coupled to said support frame;

a locking assembly coupled to said drive shaft, said locking assembly comprises a locking member pivotably coupled to said hatch to selectively engage said locking bar to lock said hatch, and a cam coupled to said drive shaft and configured to contact said locking member during rotation of said drive shaft to unlock said hatch;

a positioning assembly coupled to said drive shaft to move said hatch from the closed position to an intermediate position that is between the closed position and the open position, said positioning assembly comprises a positioning rack coupled to said hatch and a positioning pinion coupled to said drive shaft, said positioning pinion comprising at least one tooth extending outwardly from an outer surface of said positioning pinion, said at least one tooth being positioned on said drive shaft relative to said cam such that said cam unlocks the hatch before said tooth contacts said positioning rack; and a drive assembly coupled to said drive shaft for moving said hatch between the intermediate position and the open positioned, wherein said drive shaft is rotated through a first angle of rotation to cause said locking assembly to disengage said locking bar, said drive shaft is rotated through a second angle of rotation after the first angle of rotation to cause said positioning assembly to move said hatch from the closed position to the open position, and is rotated through a third angle of rotation after the second angle of rotation to cause said drive assembly to move said hatch from the intermediate position to the open position.

* * * * *